US007451707B1

(12) United States Patent
Hadden

(10) Patent No.: US 7,451,707 B1
(45) Date of Patent: Nov. 18, 2008

(54) GUN BARREL CLEANING DEVICE

(76) Inventor: Trent Hadden, 1027 Thunder Rd., Norwood, CO (US) 81423

( * ) Notice: Subject to any disclaimer, the term of this patent is extended or adjusted under 35 U.S.C. 154(b) by 0 days.

(21) Appl. No.: 11/755,632

(22) Filed: May 30, 2007

(51) Int. Cl.
*F42B 8/00* (2006.01)

(52) U.S. Cl. ..... 102/529; 102/442; 102/444; 102/498; 102/502; 102/511; 102/512

(58) Field of Classification Search ..... 102/529, 102/442, 444, 498, 502, 511, 512
See application file for complete search history.

(56) References Cited

U.S. PATENT DOCUMENTS

| | | | | |
|---|---|---|---|---|
| 1,495,008 | A * | 5/1924 | Feagin | 102/442 |
| 2,765,740 | A * | 10/1956 | Norman | 102/442 |
| 3,740,883 | A * | 6/1973 | Kyle | 102/442 |
| 4,843,750 | A * | 7/1989 | Blase | 102/442 |
| D309,339 | S | 7/1990 | Lutfy | |
| 4,998,368 | A | 3/1991 | Blase | |
| 5,341,744 | A | 8/1994 | Shi | |
| 5,777,258 | A | 7/1998 | Soon | |
| 6,389,978 | B1 | 5/2002 | Hooper et al. | |
| 2002/0129725 | A1 | 9/2002 | Bice et al. | |
| 2004/0244627 | A1 * | 12/2004 | Bice et al. | 102/442 |

* cited by examiner

*Primary Examiner*—Jacob Y. Choi
*Assistant Examiner*—Jonathan C Weber

(57) ABSTRACT

The present gun barrel cleaning device provides a special cartridge with a casing filled with a carbon dioxide charge which forwardly propels a push pin having a sliding seal near the firing pin and a two-pieced break-away seal at the opposite end, which separates to push a cloth rag and metal brush through the bore when the cartridge is loaded into the gun and the gun is fired.

2 Claims, 3 Drawing Sheets

GUN BARREL CLEANING DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Field of the Invention

The present invention relates to a device for cleaning a gun barrel, specifically the bore, such device resembles a shell and consists of a cartridge in a casing which contains a brush and a cloth rag which is propelled, upon firing the gun, through the barrel/bore by a charge of carbon dioxide gas also contained in the casing.

SUMMARY OF THE INVENTION

The present gun barrel cleaning device provides a shooter with a quick, easy way to clean a gun barrel. The gun barrel cleaning device consists of a special cartridge or shell that is loaded into the gun and fired. The cartridge is contained in a plastic or metal casing sized to fit various rifles, shotguns, or handguns. The casing contains a metal cleaning brush and cloth rag that is propelled through the barrel by a charge of carbon dioxide gas contained in the casing. The cartridge is detonated by the firing pin in the gun when the shooter pulls the trigger. The cartridge includes the appropriate seals to contain the brush, rag, and carbon dioxide charge. Alternatively, spring power may be used to propel the brush and rag through the barrel gun barrel. The present device provides a hunter/shooter a convenient, easily used device to clean a gun barrel not only after firing a shot from the gun, but also after hunting in the rain or snow even if a shot is not fired. Unfortunately, it can be hard to find the time to clean a barrel, or the hunter/shooter may be too tired after a day of hunting or target shooting. Thus, a gun barrel cleaning device which is convenient, easily used, and which saves time is needed. The present gun barrel cleaning device addresses this need by being convenient, easily used, and saves time in that it allows a hunter or target shooter to simply load the special shell into the chamber and fire a shot. The firing pin in the gun detonates the shell so that the pressure created by the carbon dioxide charge pushes the brush and rag through the barrel.

As such, the general purpose of the improved gun barrel cleaning device which has all of the advantages over prior art and many novel features that result in an improved gun barrel cleaning device which is not anticipated, rendered obvious, suggested, or even implied by the prior art, either alone or in combination thereof.

An object of the present gun barrel cleaning device is to allow a gun barrel to be cleaned by simply loading a special shell into the chamber and firing a shot.

Another object of the present gun barrel cleaning device is to provide a quick, easy way to clean a gun barrel.

Still another object of the present gun barrel cleaning device is to provide a gun barrel cleaning device which is economically priced.

Yet another object of the present device is to provide a gun barrel cleaning device which may be used to clean the barrel of a variety of rifles, handguns with a variety of calibers, and shotguns with various gauges.

Even still another object of the present device is to provide a gun cleaning cartridge containing a carbon dioxide charge, a brush, and a rag.

Even yet another object of the present device is to provide a gun cleaning cartridge containing a carbon dioxide charge, a brush and a rug, with a brush and rag saturated with cleaning solvent or lubricating oil to help the brush and rag work more effectively than without such solvent or lubricating oil.

Even still yet another object of the present device is to provide a gun barrel cleaning device which may be carried in a shooter or hunter's pocket, gear bag, or equipment box so that the device is readily accessible for use in cleaning a gun barrel.

Thus has been broadly outlined the more important features of the improved gun barrel cleaning device so that the detailed description thereof that follows may be better understood and in order that the present contribution to the art may be better appreciated.

These together with additional objects, features and advantages of the improved gun barrel cleaning device will be readily apparent to those of ordinary skill in the art upon reading the following detailed description of presently preferred, but nonetheless illustrative, embodiments of the improved gun barrel cleaning device when taken in conjunction with the accompanying drawings. In this respect, before explaining the current embodiments of the improved gun barrel cleaning device in detail, it is to be understood that the invention is not limited in its application to the details of construction and arrangements of the components set forth in the following description or illustration. The invention is capable of other examples and of being practiced and carried out in various ways. It is therefore important that the claims be regarded as including such equivalent constructions insofar as they do not depart from the spirit and scope of the present invention. It is also to be understood that the phraseology and terminology employed herein are for purposes of description and should not be regarded as limiting.

DETAILED DESCRIPTION OF THE DRAWINGS

Figure 1:
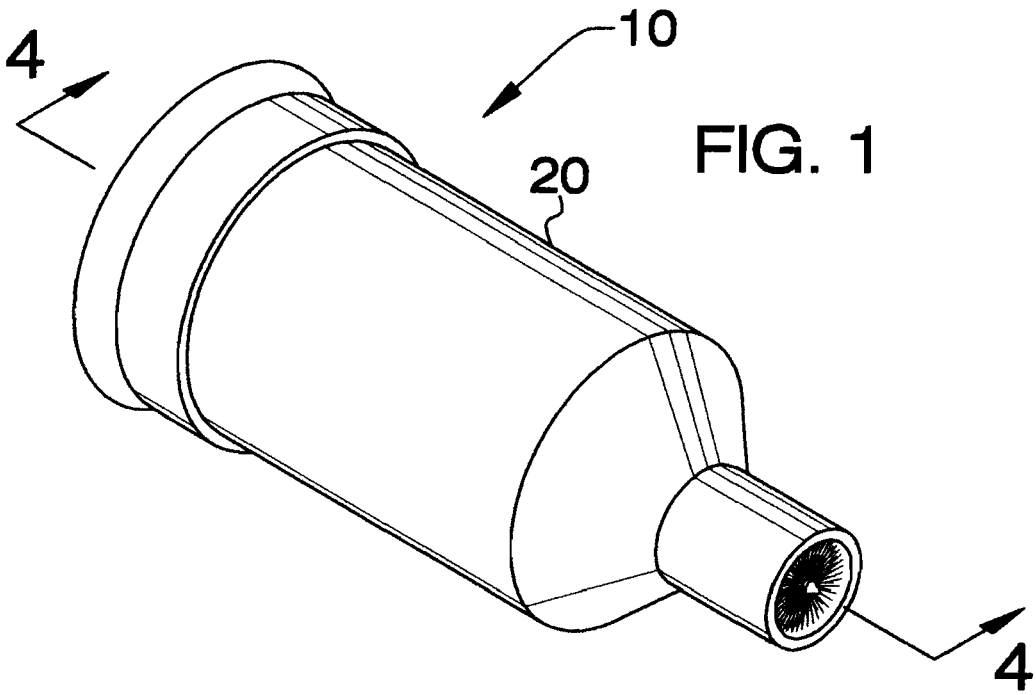
FIG. 1 is an isometric front view.
Figure 2:
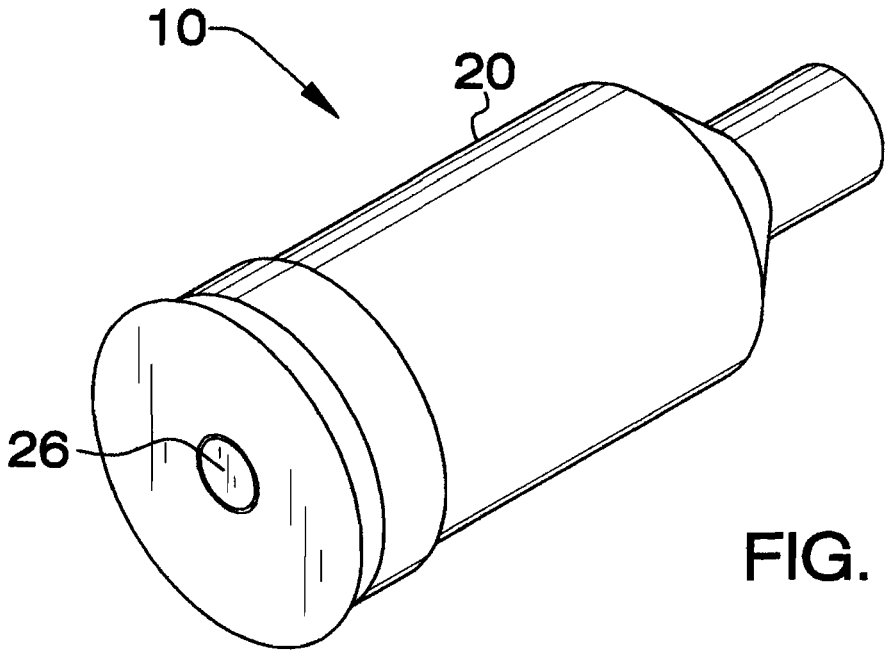
FIG. 2 is an isometric rear view.
Figure 3:
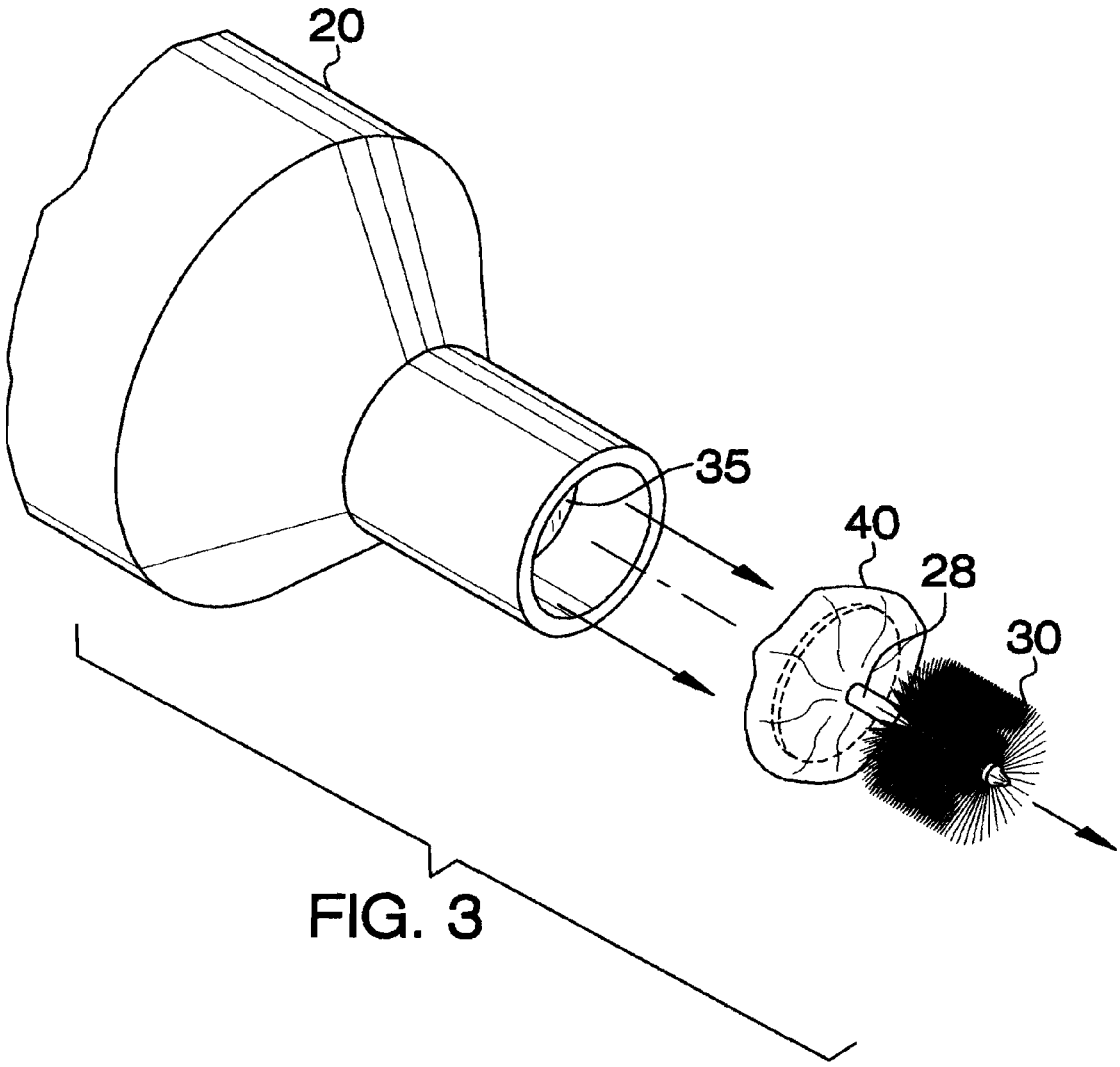
FIG. 3 is an exploded view.
Figure 4:
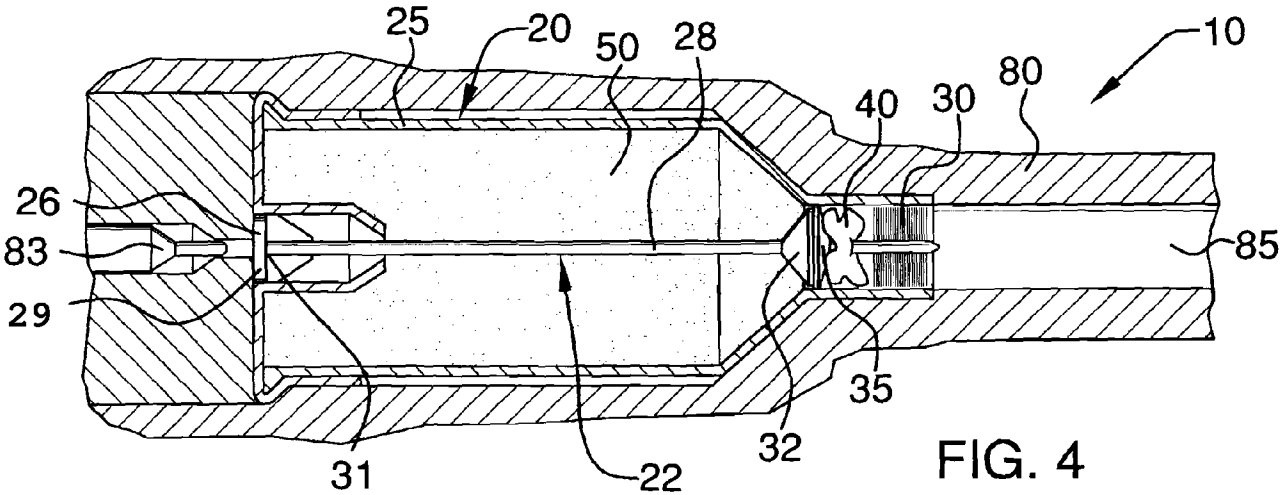
FIG. 4 is a cross section illustrating the present device inserted into the bore of the barrel of a rifle, prior to activation.

With reference now to the drawings, and in particular FIGS. 1 through 5 thereof, example of the employing the principles and concepts of the present gun barrel cleaning device and generally designated by the reference number 10 will be described.

Referring to FIGS. 1 through 5, the present gun barrel cleaning device 10 is used to clean a gun barrel 80 of a gun having a firing pin 83. The present gun barrel cleaning device 10 comprises a special shell or cartridge 20 having a plastic or metal casing 25. Said casing 25 contains a pin seal unit 22, comprising a push pin 28 having a sliding seal 26 at a proximal end 31 and a break-away seal 29 at a distal end 32 where said casing 25 narrows, a metal cleaning brush 30 and a cloth rag 40. Said parallelepiped sliding seal 26 is axially oriented with respect to said firing pin 83 and seals said casing 25 at one end. Said break-away seal 29 is formed of two removably affixed hollow frustrums, an interior frustrum 33 and an exterior frustrum 35, placed back-to-back. Said break-away seal 29, like the sliding seal, is also axially oriented with respect to said firing pin 83 and is placed on said push pin 28 in the location where said casing 25 narrows at the end of the casing near a gun bore 85. Said rag 40 is pierced by push pin 28 and is placed on said push pin 28 adjacent to said exterior frustrum 35 of the break-away seal 29. Said brush 30 is affixed to and surrounds said push pin 28 and is placed adjacent to said rag 40 located adjacent to the casing.

Figure 5:
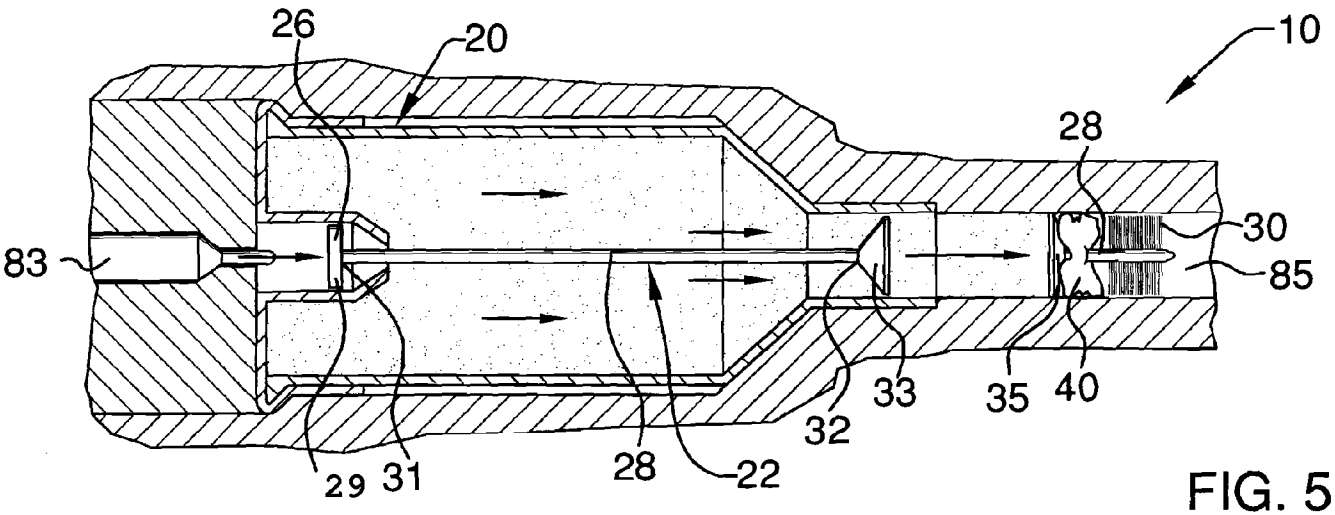
FIG. 5 is a cross section illustrating the present device activated inside the bore of a rifle barrel.

Said cartridge 20 is detonated by the firing pin 83 when the gun trigger is pulled. As shown in FIG. 5, when the firing pin 83 is activated, the firing pin 83 pushes forward into sliding seal 26, which detonates the cartridge 20 so that the pressure created by the carbon dioxide charge 50 separates the break-away seal 29, and the exterior frustrum pushes forward along with the brush 30 and rag 40 through the barrel 80 and bore 85. In an alternative embodiment, spring power (not shown) may be used to propel the brush 30 and rag 40 through the gun barrel 80.

With respect to the above description then, it is to be realized that the optimum dimensional relationships for the parts of the gun barrel cleaning device, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A gun barrel cleaning device comprising:

a cartridge having a plastic or metal casing further comprising:

a pin seal unit further comprising:

a push pin having a parallelepiped sliding seal at a proximal end and a break-away seal at a distal end where said casing narrows, said sliding seal being axially oriented with respect to a gun firing pin and sealing said casing at one end and said breakaway seal being formed of two removably affixed hollow frustrums, an interior frustrum and an exterior frustrum, placed back-to-back and being axially oriented with respect to said firing pin and placed on said push pin in the location where said casing narrows at the end of the casing near a gun bore;

a metal cleaning brush, said brush being affixed to and surrounding said push pin and being placed adjacent to a rag located adjacent to said casing; and a cloth rag, said rag being pierced by said push pin and placed on said push pin adjacent to said exterior frustrum of the break-away seal.

2. The gun barrel cleaning device of claim 1 wherein said firing pin is activated by pulling said gun's trigger causing said firing pin to push forward into said sliding seal which, in turn, detonates said cartridge casing so that the pressure created by said carbon dioxide charge separates the break-away seal, thus pushing the exterior frustrum forward along with said brush and rag through the barrel and bore to clean a gun barrel and bore.

* * * * *